United States Patent [19]

Stark

[11] 4,077,834

[45] Mar. 7, 1978

[54] DEVICE FOR THE CONTROL OF THE TENSION OF AN ENDLESS BELT OR SCREEN

[76] Inventor: Theo Stark, Munsterstrasse 104, 5100 Aachen-Brand, Germany

[21] Appl. No.: 721,161

[22] Filed: Sep. 7, 1976

[30] Foreign Application Priority Data

Sep. 13, 1975 Germany ..... 2540923

[51] Int. Cl.[2] ..... D21F 7/00

[52] U.S. Cl. ..... 162/257; 162/262; 162/273

[58] Field of Search ..... 162/273, 274, 199, 257, 162/262

[56] References Cited

U.S. PATENT DOCUMENTS

| | | | |
|---|---|---|---|
| 2,918,970 | 12/1959 | Printz | 162/273 |
| 3,140,975 | 7/1964 | Corbin | 162/273 |

FOREIGN PATENT DOCUMENTS

| | | | |
|---|---|---|---|
| 1,165,398 | 3/1964 | Germany | 162/257 |

*Primary Examiner*—Richard V. Fisher
*Attorney, Agent, or Firm*—Arthur B. Colvin

[57] ABSTRACT

The invention relates to a device for the control of the tension of an endless belt or screen in paper handling machinery by providing a deflecting roller displaceable by two bearings guided in carriages.

2 Claims, 1 Drawing Figure

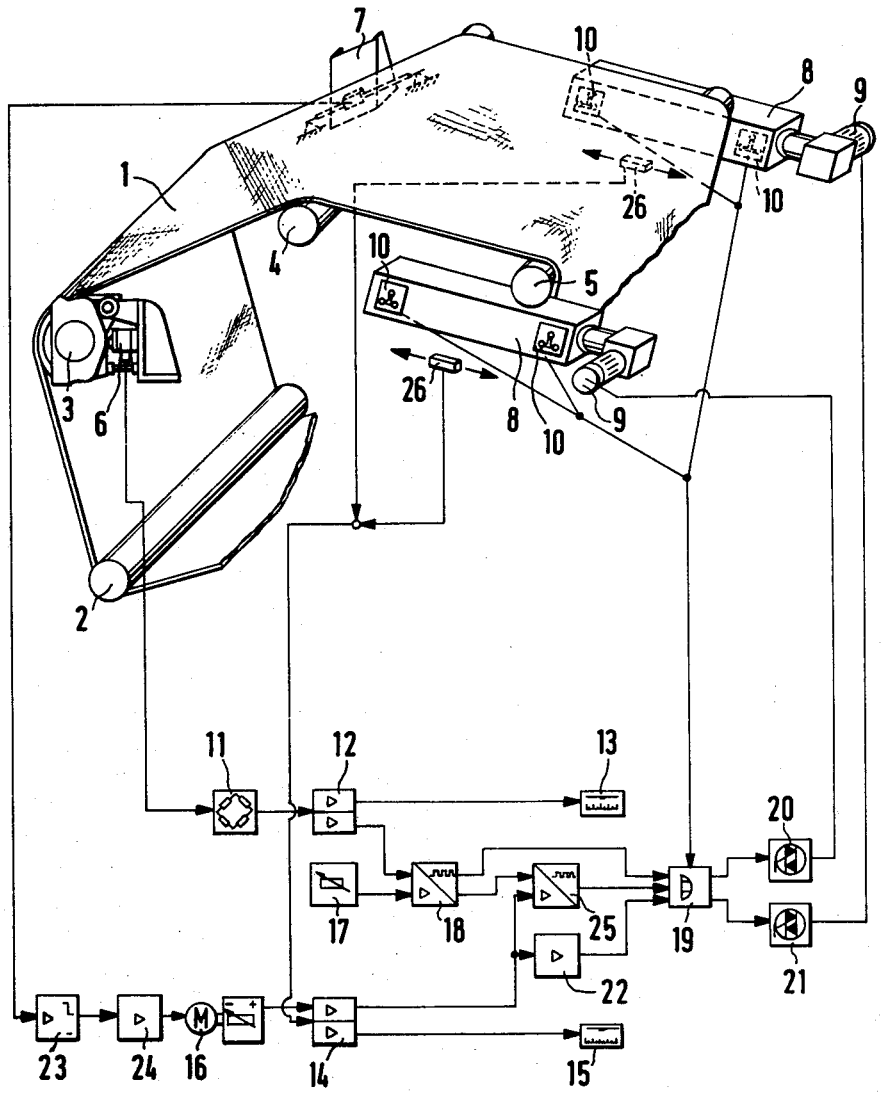
7
10
8
9
1
26
10
4
10
5
26
3
6
8
10
9
2
11
12
13
20
17
18
25
19
22
21
23
24
16
14
15

DEVICE FOR THE CONTROL OF THE TENSION OF AN ENDLESS BELT OR SCREEN

BACKGROUND OF THE INVENTION

As conducive to an understanding of the invention, it is noted that in known tension control devices, the carriages supporting the bearings of a deflecting roller are moved by means of spindles or chains, there being provided, for the purpose of maintaining uniform tension, a connecting shaft reaching from the "leader" side to the "drive" side of the paper handling machine, assuring synchrony of the carriages without travel-length difference. In order to effect a correction of so-called "off" belts or screens so that the distribution of tension becomes linear over the entire width of the belt or screen, it is also known to equip the connecting shaft with a mechanical clutch so that, for instance, by unplugging a pin, the connection is temporarily interrupted in order to achieve a carriage movement differing in distance traveled on the "leader" side and the "drive" side. The thus established uniform belt or screen tension is kept up by means of the re-engaged connecting shaft.

In order to be able to correct the runoff of the belt or screen edges, it is known to provide a pivotably mounted guide roller whose bearings are adjusted more or less as a function of the correct running of the edges, such as through pneumatic control devices. It is not possible with such known belt or screen runoff controls to influence the belt or screen tension so that, in addition to the control devices for the correct running of the edges, separate tension control devices are always required in known paper handling machines.

BRIEF SUMMARY OF THE INVENTION

It is an object of the invention to provide a mechanism for the control of the tension of an endless belt or screen for paper handling machines which permits permanent correction of deviations of the belt or screen circulation from the correct running of the edges without the need for an additional guide roller.

Starting from a tension control device for an endless belt or screen as described at the outset, the invention suggests, in order to solve the problem posed, than an adjustment device with a motor be provided for each carriage, the motors to have one common monitoring and control unit by means of which the carriages are adjustable selectively with or without travel-length difference.

The mechanism according to the invention obviates not only a connecting shaft to synchronize the carriages for belt or screen tension, but also a pivotably mounted guide roller to correct a belt or screen circulation deviating from the correct running of the edges, because the electronic monitoring and control unit provided for the two motors jointly makes it possible to adjust the deflecting roller parallel for tension control and to pivot it for run-off control.

According to one embodiment of the invention, the mechanism may comprise means for picking up the run-off of the belt or screen edges, these means being able to release pulses for a correcting carriage stroke.

Whereas, in the known devices for linear tension distribution, synchronization of the carriages for the deflecting roller bearings is accomplished by a connecting shaft and a separate, pivotably mounted guide roller serving the specific purpose of run-off control, the mechanism according to the invention makes it possible not only to generate pulses for the synchronization of the carriages for belt or screen tension control, but, in addition, to release run-off control pulses effecting a corrective bearing carriage stroke, pivoting the deflecting roller and thus assuming the function of the known guide roller.

Finally, according to another embodiment, the invention also suggests that the electronic monitoring and control unit contain a motor actuated set-point transmitter.

The design according to the invention makes it possible to preset difference set-points corresponding to a closed control loop, the motor actuated set-point transmitter providing the possibility of pre-setting the set-point for a difference adjustment as required to keep the edges of the belt or screen in certain positions or to return them constantly to these positions.

Position indicators, preferably of the contactless type known per se, triggering an appropriate corrective bearing carriage stroke depending on the deviations from the correct edge positions, may be used for the continuous determination of the edge positions.

Accordingly, the mechanism according to the invention eliminates a separate belt or screen run-off control including the mechanical part required therefor. Due to the fact that this also eliminates the space problems relating to the accommodation of a separate belt run-off control, the belts or screens can be kept considerably shorter without losing effectiveness.

BRIEF DESCRIPTION OF THE DRAWING

In the accompanying drawing in which is shown one of various possible embodiments of the various features of the invention, the single FIGURE is a schematic representation of the system.

DETAILED DESCRIPTION OF THE INVENTION

Referring now to the drawings, the depicted portion of an endless belt 1 is led across deflecting rollers 2, 3, 4 and 5, a magneto-elastic force recorder 6 to pick up the belt tension being associated with the deflecting roller 3. An edge scanning device 7 is disposed in the area of the deflecting roller 4 for the determination of the prevailing belt running position.

The journals of the deflecting roller 5 (not shown in the drawing), turn in bearings (also not shown) which are movable by means of carriages, covered up by housing 8, through spindless driven by three-phase gear motors 9. End position limit switches 10 limit the movement of the carriages and thus also the displacement of the deflecting roller 5.

The magneto-elastic force recorder 6 is connected to a bridge 11 wired to a double measuring amplifier 12 which serves the purpose of indicating the belt tension and for setting the actual value for the control loop. A moving coil tensiometer 13 connected to the double measuring amplifier 12 indicates the belt tension in kp/cm.

Another double measuring amplifier 14, again associated with a moving coil tensiometer 15 to indicate the travel-length difference between the so-called "leader" and "drive" side serves the purpose of indicating the travel-length difference between the "leader" and "drive" side and indicating the actual value for the bearing control loop.

The double measuring amplifier 14 is connected to a motor potentiometer 16, a superposed set-point tending to keep the belt edge in a defined position.

A set-point transmitter 17 serves the preselection of the desired belt tension and is connected to a three point control 18 with contactless output. The three point control 18 influences an electronic logic circuit 19 for the required electric wiring between belt run-off control and belt tension. Connected to the logic circuit 19 is a thyristor output stage 20 for reverse operation for the purpose of feeding the three-phase gear motor 9 of the "leader" side. In addition, there is connected to the logic circuit 19 a thyristor output stage 20 for reverse operation for the purpose of feeding the three-phase gear motor 9 on the "leader" side. In addition, there is connected to the logic circuit 19 a thyrister output stage 21 for reverse operation for the purpose of feeding the three-phase gear motor 9 on the "drive" side.

Another three point control 22 with contactless output serves the purpose of superimposing an additional correction component required due to the belt run-off control.

The belt edge scanner 7 is connected to an electronic logic circuit 23 succeeded by an amplifier 24 to feed the motor actuated difference set-point transmitter from the motor potentiometer 16.

The logic circuit 25 takes care of the synchronization between "leader" and "drive" side, analog displacement transducers being provided on both sides.

MODE OF OPERATION OF THE INVENTION

The operating mode of the mechanism is as follows:

Before the circulating of the belt 1 is started, it receives a minimum tension so that a destruction of the belt 1 due to the formation of folds can be avoided and a run-off correction made possible right from the start. The minimum tension of the belt 1 is controlled in that the prevailing belt tension is picked up by the magneto-elastic force recorder 6 via the associated bridge 11 and the measuring amplifier 12 and caused to be displayed by the moving coil tensiometer 13.

When the minimum belt tension is reached, the belt run-off control is started. For instance, if the "leader" side of the belt 1 is to advance by a certain amount relative to the "drive" side so as to assure proper running of the edges, the electronic logic circuit 22, receiving its information via the analog displacement transducer 26 succeeded by the double measuring amplifier 14 with consideration of the motor potentiometer 16, sees to it that the continuous motion of the leading side is interrupted until synchrony is reestablished. This means in the assumed example that the three-phase gear motor 9 drive system on the "drive" side is stopped until, taking into account the difference set-point, the "leader" side has attained the desired position relative to the "drive" side. For the relief operation, assuming the same mutual relationship, this would mean that it would not be the three-phase gear motor 9 on the "drive" side, but the corresponding motor 9 on the "leader" side which would have to remain stopped, because, when relieving, it is the "leader" side which is leading relative to the "drive" side.

If, after the attainment of the desired belt tension, the belt edge runs off due to the effect of whatever interference, the magnitude of the rquired difference between the "leader" and the "drive" side will be determined by the electronic logic circuit 23 and given to the motor potentiometer 16 via the measuring amplifier 24. The three point control 25 with contactless output then initiates an appropriate correction on the 37 drive" side which is located in back in the drawing.

Having thus described my invention, what I claim as new and desire to secure by Letters Patent of the United States is:

1. Apparatus for controlling both the tension and edge run position of an endless belt or screen in a paper handling machine, comprising a unitary deflecting roller, first and second bearing means at the opposite ends of said roller, said bearing means rotatably supporting said roller, each said bearing means being movably mounted in a slide member, first and second motor means operatively associated with said first and second bearing means, respectively, for individually displacing its associated bearing relative to a said slide, first electronic monitoring control means operatively connected to said first and second motors and responsive to the tension in said belt or screen for activating said motors to shift said bearings in said slides and thereby achieve a desired tension in said belt or screen, and second electronic monitoring control means responsive to the positions of the edges of said belt or screen for activating said motors to shift said bearings in said slides to achieve a desired edge position of said belt or screen, whereby both the position and tension of said belt or screen are controlled by said deflecting roller.

2. Apparatus according to claim 1, characterized in that at least one said electronic monitoring control means contains a motor-actuated set-point transmitter.

* * * * *